United States Patent [19]

Linnér

[11] 4,120,741

[45] Oct. 17, 1978

[54] CARTON SEALING STRIP APPLICATOR

[75] Inventor: Hans Rolf Ingemar Linnér, Helsingborg, Sweden

[73] Assignee: AB Akerlund & Rausing, Lund, Sweden

[21] Appl. No.: 842,571

[22] Filed: Oct. 17, 1977

Related U.S. Application Data

[63] Continuation of Ser. No. 777,722, Mar. 15, 1977, Pat. No. 4,069,093.

[30] Foreign Application Priority Data

Nov. 12, 1976 [SE] Sweden ..... 7612636

[51] Int. Cl.[2] ..... B26D 5/00; B31B 1/72

[52] U.S. Cl. ..... 156/522; 53/137; 93/36.9

[58] Field of Search ..... 156/521, 522, 510, 355, 156/DIG. 33; 53/137; 93/36.9

[56] References Cited

U.S. PATENT DOCUMENTS

| | | | |
|---|---|---|---|
| 1,627,363 | 5/1927 | Webster | 53/137 |
| 2,157,735 | 5/1939 | Brite | 156/353 |
| 2,291,280 | 7/1942 | Joplin | 53/137 |
| 2,372,780 | 4/1945 | Hess | 83/593 |
| 2,564,901 | 8/1951 | Hess | 156/351 |
| 2,604,825 | 7/1952 | Sieg | 93/36.9 |
| 3,196,591 | 7/1965 | Guido et al. | 53/137 |
| 3,237,370 | 3/1966 | Ouellette | 53/137 |
| 3,282,018 | 11/1966 | Bixley | 53/137 |
| 3,406,084 | 10/1968 | Varga | 156/522 |
| 3,488,243 | 1/1970 | Pesch et al. | 156/354 |
| 3,577,293 | 5/1971 | Ritterhoff | 156/521 X |
| 3,654,038 | 4/1972 | Hottendorf | 93/36.9 X |
| 3,800,679 | 4/1974 | Bartelheimer | 93/36.9 |
| 3,915,786 | 10/1975 | Collett et al. | 156/355 |
| 3,954,550 | 5/1976 | Patterson | 156/486 |
| 4,069,093 | 1/1978 | Linner | 156/522 |

*Primary Examiner*—Michael G. Wityshyn
*Attorney, Agent, or Firm*—Lerner, David, Littenberg & Samuel

[57] ABSTRACT

A packaging machine is disclosed in which carton sealing is accomplished by applying a sealing ribbon to an open end of a folding flap carton in a series of same. The ribbon is then cut, withdrawn a predetermined distance, adhered to an open end of the next carton in the series and ribbon tension is relieved as the next carton is fed with the ribbon adhered thereto.

8 Claims, 5 Drawing Figures

CARTON SEALING STRIP APPLICATOR

This is a continuation of application Ser. No. 777,722, filed Mar. 15, 1977, now U.S. Pat. No. 4,069,093.

BACKGROUND OF THE INVENTION

The present invention relates to packaging machines in which a series of folding boxes fed one after another in a predetermined direction with a substantially constant center to center distance are processed in various stations and, more particularly, to a sealing strip applicator station for such a machine which is adjustable for processing different size boxes.

Principally, such a machine comprises an endless conveyor, such as a chain or a band running in the horizontal plane and provided with equally spaced carriers for folding boxes of cardboard or similar material. From a plane condition in a storage area, the folding boxes are fed to the conveyor and simultaneously erected into a substantially case-shaped configuration with top and bottom endwall flaps extending from the body portion of the folding box. In a conventional machine of this type the erected folding boxes are conveyed to the following stations: a transverse wall and longwall flap unfolding station, a sealing ribbon application and sealing station, a sealing ribbon cross-cutting station and a flap folding and sealing station. These stations are located along a rectilinearly extending portion of the conveyor and operate upon the bottom ends of the folding boxes. After the bottom sealing has been accomplished, at the end of the rectilinear portion the folding boxes are filled in a filling station, preferably situated along a curved portion of the conveyor, after which the folding boxes are conveyed along a second rectilinear portion in a direction opposite to that of the first rectilinear portion. With the exception of the transverse-wall and longwall flap unfolding station, the second rectilinear portion is provided with stations identical with those of said first portion, however with the difference that the latter operate upon the top ends of the folding boxes. At the end of the second rectilinear portion there is a discharge station for the filled and sealed folding boxes.

Basically, this machine is reliable and practical. However, it would be desirable to provide a sealing strip applicator wherein size adjustments within a maximally large size range may be made. With the known machine in such a case difficulties are encountered in the adaptation of the length of the sealing strip to be applied to the various folding boxes of different size.

It is therefore an object of this invention to provide a size adjustable sealing strip applicator.

A further object of this invention is to provide a sealing strip applicator wherein the sealing strip applied to each individual folding box is exactly the size which is necessary for the actual box size so that no waste material is generated.

Another object of this invention is to provide a reliable sealing of the sealing strip independent of the folding box size.

SUMMARY OF THE INVENTION

This invention accordingly provides an arrangement for use in a size-adjustable packaging machine, in which a sealing strip is sealed to at least one open end of each folding box in a series of folding boxes fed one after another in a predetermined direction with a substantially constant center to center distance. The sealing strip is formed by cutting a length from a continuous ribbon of the sealing material. The arrangement according to the invention is characterized by means to cross-cut the ribbon in a stationary cross-cutting station; means for withdrawing the ribbon a predetermined distance after the cross-cutting in the cross-cutting station; means to adhere the ribbon over said open end of the next folding box. Further, there is provided means to relieve stressing of the ribbon during repeated feeding thereof to the cross-cutting station, the ribbon feeding speed being substantially equal to the feeding speed of the folding boxes.

DESCRIPTION OF THE DRAWING

In order to clearly explain the inventive concept a preferred embodiment thereof now will be described with reference to the drawings in which.

DESCRIPTION OF THE PREFERRED EMBODIMENT

Figure 1:
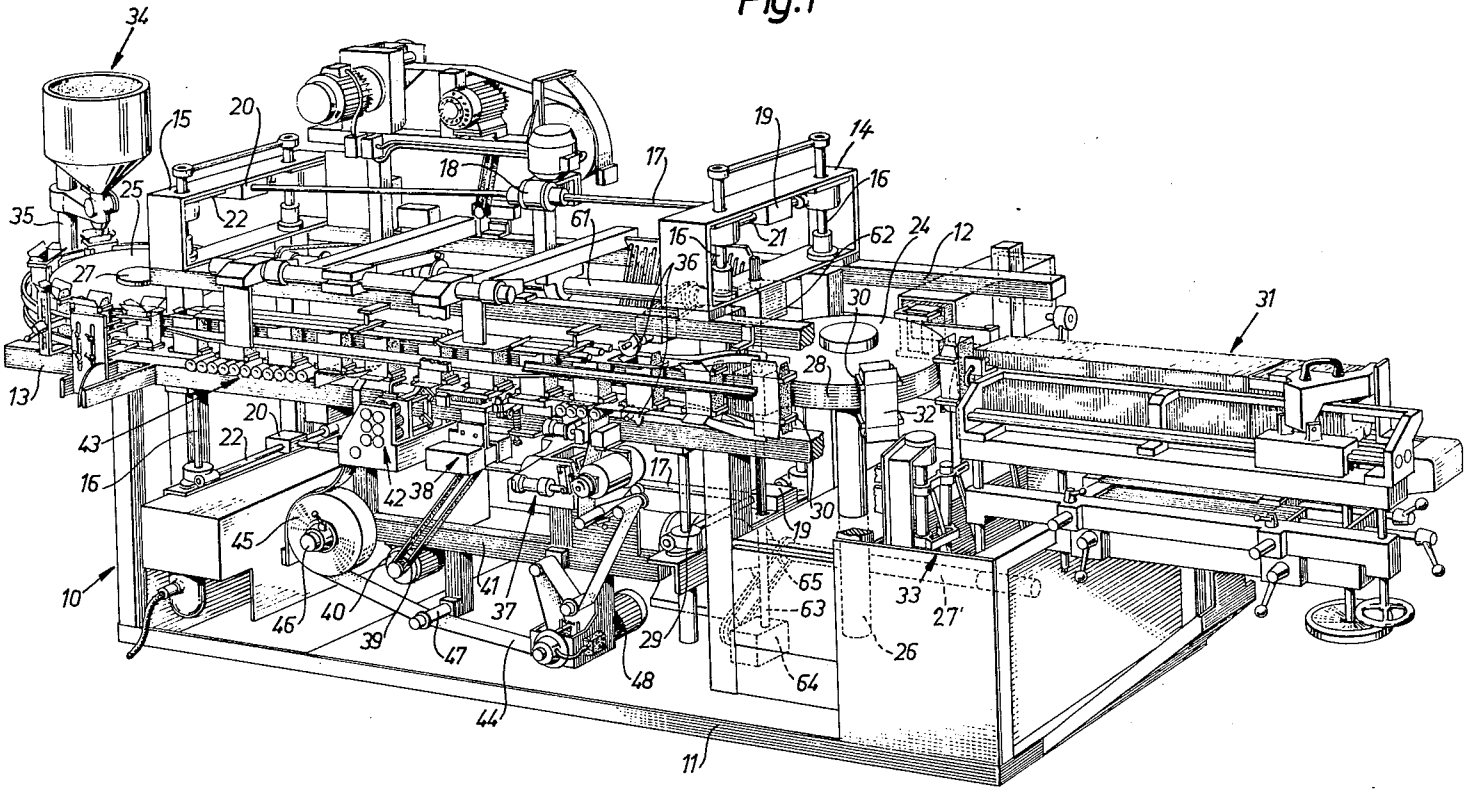
FIG. 1 is a perspective view of a packaging machine including the arrangement according to this invention.

The packaging machine shown in FIG. 1 is provided with a main stand 10 which by means of a bottom frame 11 rests upon a substantially horizontal floor. The main stand 10 carries an upper deck 12 and a lower deck 13, respectively, which are simultaneously vertically displaceable in opposite directions. Each of said decks consists of a frame structure. In the area of the transverse ends the upper deck 12 is provided with boxlike housings 14 and 15. Each of the housings serves as a guide means for the top ends of a pair of jack screws 16. The housings 14 and 15 are interconnected by means of a shaft 17, which is driven by a worm gear motor 18, and by means of worm gears 19, 20 in the two housings 14, 15 transverse shafts 21, 22 are driven which in turn rotate the screws 16 when the motor 18 is running. The lower deck 13 is provided with a corresponding set of shafts and worm gears and a worm gear motor. Owing to the fact that the screws 16 have oppositely threaded portions in the areas of the deck 12 and the deck 13, respectively, the deck 12 and deck 13 will be moved vertically in opposite directions responsive to the rotation of the screws 16. If the threads of screws 16 have the same pitch, the movement in opposite directions of course will have equal displacements.

The stand 10 by means of shafts 26, 27 carries a pair of wheels 24, 25 about which an endless steel band 28 is running and extends in the horizontal plane. The shaft 26 by means of a drive shaft 27' is driven from a main motor 29. The wheel 24 therefore is the driving wheel of the two wheels 24, 25, and by controlling the motor 29, such as by frequency control, the wheel 24 and accordingly the band 28 may be given a desired driving speed, at which the movement in the shown embodiment will be an intermittent movement with a variable speed. On the band 28 are mounted equidistant carriers 30. In the shown embodiment carriers for folding boxes of moderate size are shown, but these carriers may be replaced by carriers of a smaller or larger size, and thus the distance between the carriers, as measured between adjacent carrier arms, will vary dependent upon the selected folding box size. It is for instance possible to use folding boxes having a length in the conveying direction as small as 65 mm and as large as 142 mm. The carriers 30 are tightened on the band 28 and are easily replaceable.

At the right end of the machine shown in FIG. 1 the stand 10 carries a storage area 31 for folding boxes in plane condition. The storage area 31 is provided with a gripper means 33 which removes individual plane folding boxes from the storage area and inserts them one by one into the carriers 30 while the folding boxes simultaneously are erected as shown in FIG. 1. The storage area and the gripper means are of the type described in copending U.S. Pat. application Ser. No. 777,720, filed concurrently herewith (now U.S. Pat. No. 4,070,952). At the curved left end of the conveyor in FIG. 1 is mounted a filling means 34 which may be carried either directly by the stand 10 or, as indicated, by a separate stand 35.

Apart from a pair of endflap unfolders 36, along the two straight conveyor portions identical processing stations are provided for the bottom ends and top ends of the folding boxes, and in this connection therefore merely the processing stations for the bottom ends will be described, i.e. the stations and means carried by the lower deck 13.

With reference to the endflap unfolders 36 these are of known construction, such as of the type described in Swedish Pat. Nos. 342,180; 342,181 or 343,519. The purpose of the flap unfolders is to unfold the upper and lower transverse flaps into a horizontal position, in order to make it possible to apply a sealing label against the bottom end and the top end, respectively, of the folding box. The longwall flaps are also unfolded into horizontal position by longwall flap guide means preceding the unfolders 36.

As seen in the conveying direction, after the flap unfolders 36 follows the sealing strip application station 37 according to the invention. The details thereof appears from FIGS. 3–5 and will be described in connection therewith.

After the sealing strip application station, still as seen in the conveying direction of the folding boxes, follows a sealing strip sealing station 38 which in the shown embodiment is provided with a vibration heating jaw, such as of the type described in U.S. Pat. No. 3,787,257. The vibration heating jaw in the sealing station 38, by means of a chain 39, is driven from a drive motor 40 controlled in response to the speed of the main motor 29. This means that the vibration frequency of the heating jaw will be directly dependent on the speed of the motor 29 and consequently also on that of the conveyor band 28. Like the various units in the sealing label application station 37, this motor 40 is carried by a subframe 41 secured to the lower deck 13.

After the sealing strip sealing station 38 follows a transverse-flap folding station 42 having a special folding mechanism described in U.S. Pat. application Ser. No. 777,721, filed concurrently herewith. Then follows a known longwall flap folder in the shape of lengthened rails (not shown) serving as guide means for said flaps and folding them inwards over the transverse flaps previously folded inwards in the station 42. Said longwall flap folder alternatively may be of a type similar to that of the transverse flap folder.

At the end of the straight portion of the conveyor is situated a flap sealing station 43 which consists of a number of conventional heating elements.

After the individual folding boxes have been conveyed along the straight portion of the conveyor just described, they are ready to be filled from their top in the filling station 34.

Figure 3:
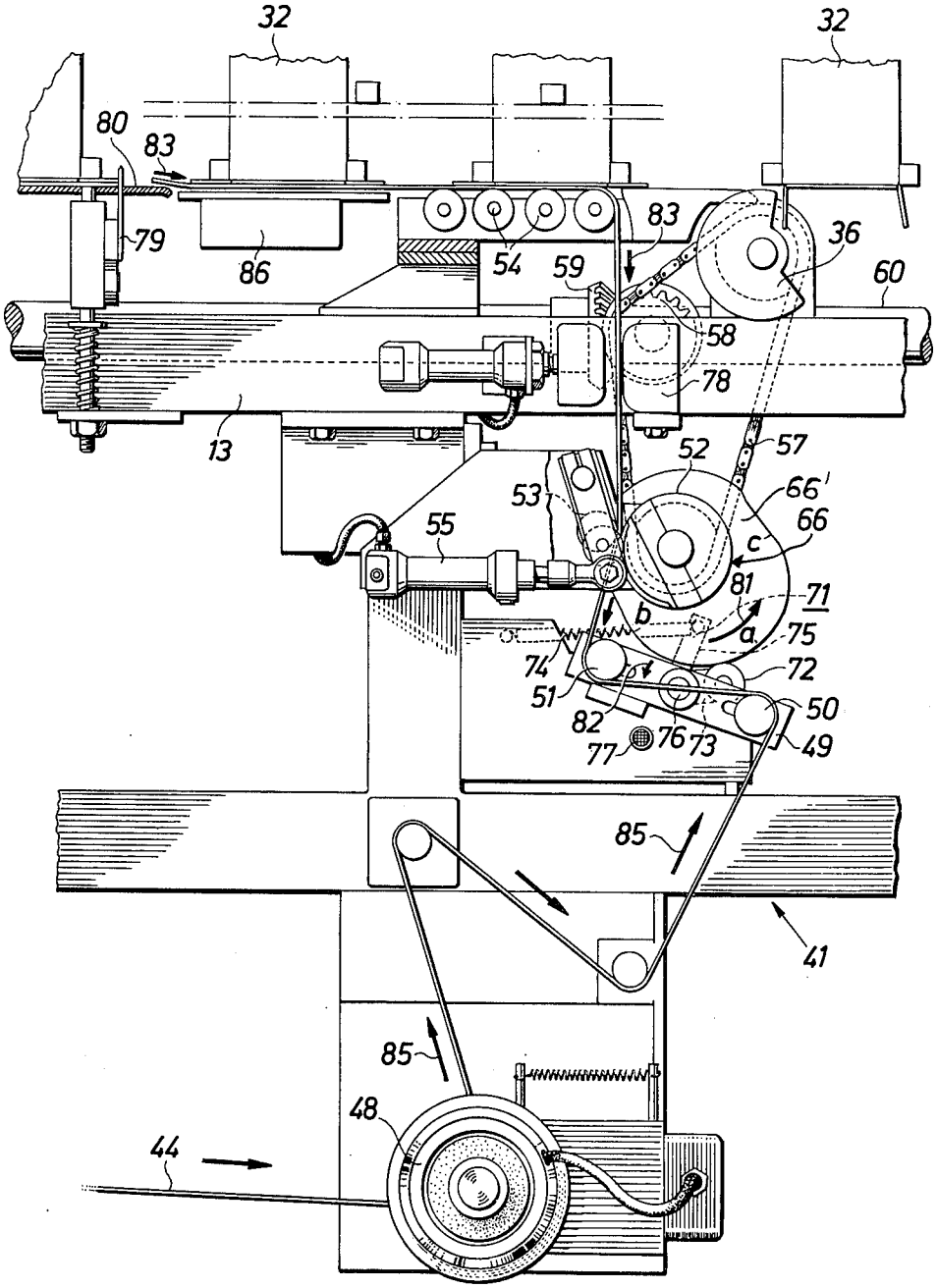
FIGS. 3–5 illustrate various phases of the handling of the sealing ribbon.
Figure 4:
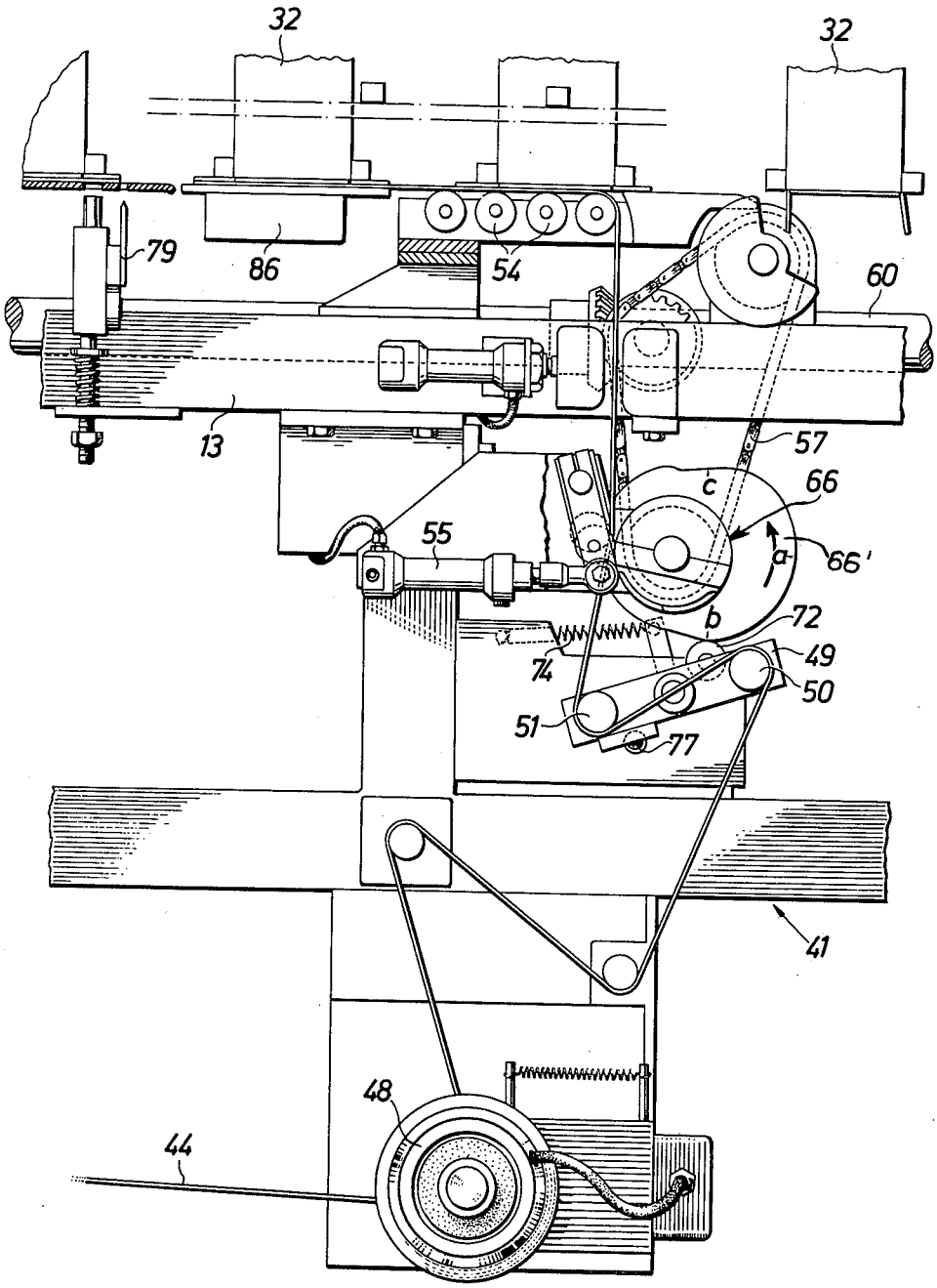
Figure 5:
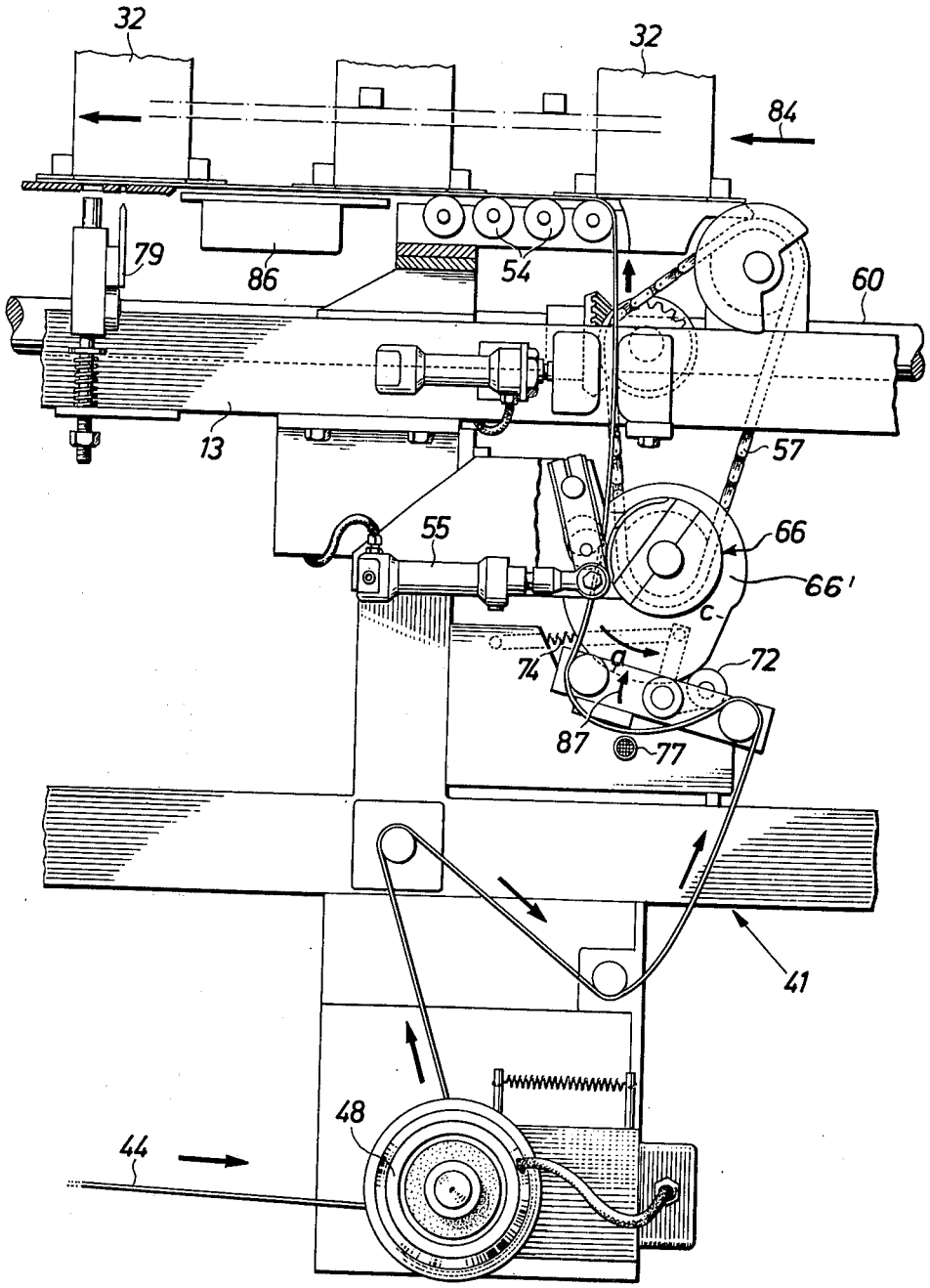

In accordance with the principles of this invention, the sealing strip applicator generally indicated by reference numeral 37 in FIG. 1 is provided. The sealing material in the shape of a ribbon 44 is fed from a storage roller 45 which is carried on a shaft 46 secured to the subframe 41. By means of a guide means 47 the sealing ribbon 44 extends forwards to a pair of rollers (not shown) driven by a motor 48, and by means of a number of further guide means the sealing ribbon extends to and past a rocker arm 49 (FIGS. 3–5). On said rocker arm 49 the ribbon extends respectively over and below a guide means 50 and 51, respectively. From the rocker arm 49 the ribbon extends between a pair of rollers 52, 53 and upwards to a number of pulleys 54 positioned immediately below the paths of movement of the bottom ends of the folding boxes 32. By means of a piston-cylinder assembly 55 the roller 53 may be pressed against the roller 52. The time for this pressing action and the duration thereof will be discussed in connection with the description of the function of the sealing strip applicator.

Figure 2:
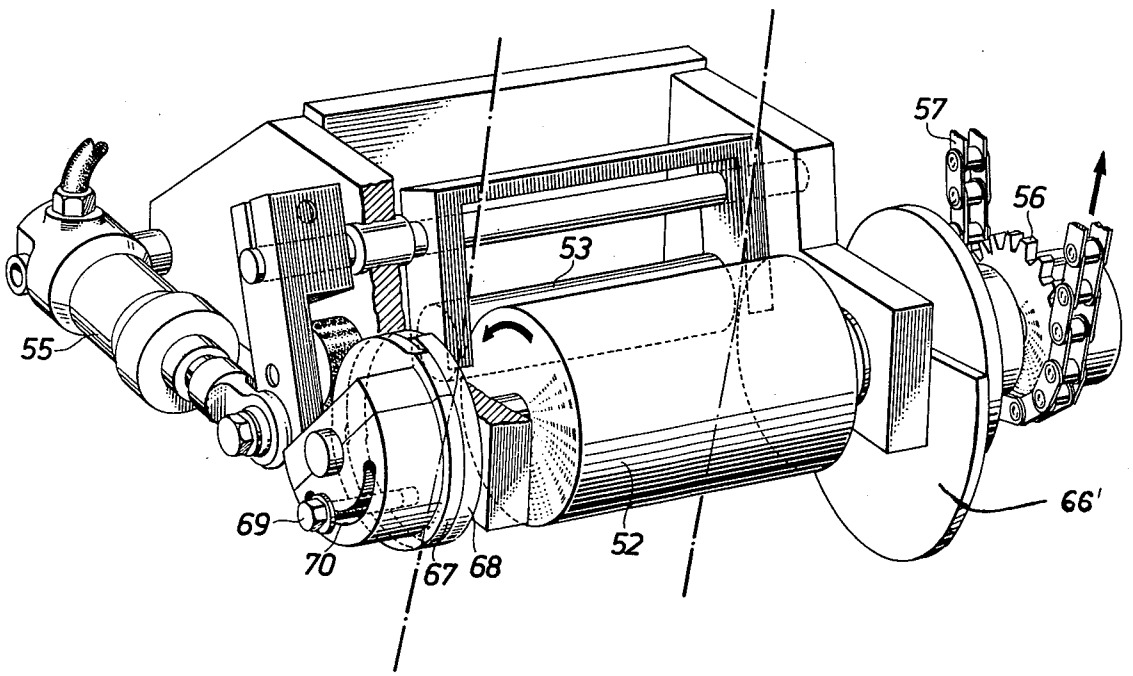
FIG. 2 is a perspective view of a pair of rollers included in the ribbon withdrawal means and an adjustable cam means used to control a rocker arm (FIGS. 3–5) which is also included in the strip withdrawal means.

The roller 52 is driven by a sprocket 56 (FIG. 2) by means of a chain 57 which also drives the transverse-flap unfolder 36. The chain 57 is driven by a sprocket 58 which in turn is driven by a worm 59 on the cam shaft 60 of the lower deck 13. FIG. 1 shows the cam shaft 61 of the upper deck, and as appears from this figure said cam shaft 61 by means of a worm gear 64 and a chain 65 is driven from the main motor 29. The cam shaft 60 of the lower deck 13 is not shown in FIG. 1, but is driven exactly in the same way as the cam shaft 61.

At the end of the roller 52 opposite the sprocket 56 a cam means 66 is rigidly mounted on the roller. As appears from FIG. 2 this cam means 66 consists of two mutually readjustable cam disks 67,68, which by means of a bolt 69 and a curved groove 70 may be adjusted into a desired mutual position. The reason therefor will appear from the description of the function.

As appears from, for instance, FIG. 3, the rollers 52, 53 and the piston-cylinder assembly 55 are carried by the lower deck 13. This also applies to the rocker arm 49 and the elements associated therewith as well as the subframe 41 previously discussed in connection with FIG. 1.

In the path of movement of a further cam means 66' is mounted a cam follower mechanism 71 to which the abovementioned rocker arm 49 is rigidly coupled. The cam follower mechanism 71 includes a cam follower roller 72 secured to an angle arm 73 which is rigidly secured to the rocker arm 49, and a second angle arm 75 loaded by a spring 74.

In the path of movement of the rocker 49 is mounted a switch means 77. Upon the actuation thereof by the rocker arm 49 the feeding of the ribbon 44 from the motor 48 is interrupted. Between the rollers 54 and the roller mechanism 52, 53 along the path of movement of the ribbon is mounted a pair of jaws 78. The purpose of the jaws 78 is to prevent a withdrawal of the ribbon in the event that a folding box carrier which is in cross-cutting position for some reason proves to be empty.

Inasmuch as this does not form a part of the present invention, said jaws will not be further described.

The leading edge of continuous sealing ribbon 44 extends at its furthest to a blade means 79 controlled by a cam (not shown) in the cross-cutting position of the respective folding box 32, blade means 79 is moved upwards across the path of the ribbon 44 and past a holder-on 80 in order to cross-cut the ribbon 44.

A description of the function of the sealing strip applicator according to the invention will now be made by reference to FIGS. 3–5.

FIG. 3 shows the position in which the ribbon 44 just has been cross-cut and the withdrawal of the ribbon 44 has been initiated. The blade 79 is still in its upper position and the band conveying the folding boxes 32 is stationary. In this position the piston-cylinder assembly 55 has moved the roller 53 to be pressed against the roller 52 which by means of the described driving arrangement rotates in the direction of the arrow 81. It is seen that when this rotation of the cam means 66' takes place and the ribbon 44 is in driving engagement with the roller 52, upon movement of the cam follower roller 72 along the distance *a* – *b* of the cam means 66', the rocker arm 49 will pivot in the direction of the arrow 82 because the spring 74 keeps the roller 72 in engagement with the cam surface of the cam means 66'. Therefore, the ribbon above the cam means 66' will be pulled in the direction indicated by the arrows 83, i.e. in a direction oppositely to the normal conveying direction 84 of the folding boxes 32 (FIG. 5).

Since the switch means 77 in this position is not actuated by the rocker arm 49 the motor 48 still will feed strip 44 to the rocker arm 49, as indicated in FIG. 3 by the arrows 85.

In the position according to FIG. 3 a pre-welding jaw 86 is positioned spaced beneath the plane of withdrawal of the ribbon 44.

However, when the cam means 66', 66 and the cam follower roller 72 assume the mutual position appearing from FIG. 4, the switch 77 is actuated in this position, and therefore the feeding of the ribbon 44 from the storage roller 45 ceases. Further, in this position the ribbon withdrawal above the rocker arm 49 is finished. The contact time between rollers 53 and 52 is determined by the mutual position between the disks 67, 68. Said position determines the contact time for a cam follower roller (shown in FIG. 2 between the roller 53 and the cylinder-piston assembly 55). The roller 53 returns to a position out of contact with the roller 52 and the pre-welding jaw 86 is pressed into contact with the bottom opening of the folding box 32 being in a pre-welding position, in order to perform a pre-welding to adhere ribbon 44 to that box. The cam means 66' and 66 of course is still rotating. However, the cam surface between the points *b* and *c* is substantially concentric with the rotation axis of the cam means, and therefore the position of the rocker arm 49 between said points will not change. However, as the cam follower roller 72 assumes a mutual position relative the cam means 66' substantially corresponding to the point *c*, the rocker arm 49 starts a rotation movement according to the arrow 87 in FIG. 5. As a result, the actuation of the switch means 77 is neutralized and the feeding of the ribbon 44 from the motor 48 is resumed. Simultaneously the band 28 again is started, and the folding boxes 32 are conveyed in the direction of the arrow 84 with an accelerating speed, at least during the first period of the total time required to assume a new sealing strip cross-cutting position. This means that in order to ensure that the effected pre-welding of the ribbon will not be adversely affected, all counteracting tensile stress upon this accelerating movement must be counteracted. During the movement of the cam follower roller 72 between the points *c* and *a* the rocker arm 49 rapidly pivots upwards and this movement will substantially compensate the acceleration of the folding boxes. Simultaneously new ribbon 44 is fed by means of the motor 48. In FIG. 5 there is shown a certain slackening of the ribbon 44 which is preferred for safety reasons, but it is also possible to form the cam curve between the points *c* and *a* in such a manner that said slackening will not be appreciable.

It should be observed that since the cam means 66' and accordingly also the rocker arm 49 is driven from the cam shaft 60, which in turn is directly controlled in response to the speed of the main motor 29, the compensating movement of the sealing ribbon will entirely follow the actual feeding speed of the folding boxes. By means of the individual cam disks 67, 68 (FIG. 2) it is possible to simply provide the withdrawal in such a manner that the withdrawal exactly corresponds to the actual folding box size with the leading edge of ribbon 44 aligned with the leading edge of the box 32 spaced above pre-welding jaw 86, as shown in FIG. 4.

Accordingly, there has been described an improved carton sealing strip applicator. It is understood that the above-described embodiment is merely illustrative of the application of the principles of this invention. Numerous other arrangements may be devised by those skilled in the art without departing from the spirit and scope of this invention, as defined by the appended claims.

What is claimed is:

1. Sealing strip applicator apparatus for use in a packaging machine in which a series of folding boxes is fed one after another in a predetermined direction with substantially constant center-to-center distances and a sealing strip is applied to at least one open end of each folding box, the sealing strip being formed by cutting a length from a continuous ribbon of sealing material, said apparatus comprising:

means for feeding said sealing ribbon parallel to at least first and second boxes;

means for adhering said ribbon to said open end of said first box when said first and second boxes are in a first position;

means for feeding said first and second boxes to a second position wherein said second box occupies the position previously occupied by said first box;

means for cutting said ribbon at the trailing edge of said first box at a cutting station with said first and second boxes in said second position; and means responsive to the operation of said cutting means for withdrawing the sealing ribbon a distance equal to the distance between said first and second boxes so that the leading edge of said ribbon is aligned with the leading edge of said second box.

2. The apparatus of claim 1 wherein said withdrawing means comprises:

a pair of rollers adapted to be pressed into engagement with each other, one of said rollers being driven, the ribbon running between said rollers; and means for moving the other of said rollers, said moving means operative for a predetermined time after the operation of said cutting means to move said other of said rollers into pressure engagement with said driven roller with the ribbon engaged therebetween for driving engagement by said driven roller, in a directin opposite to the ribbon feeding direction.

3. The apparatus according to claim 2 wherein said moving means includes:

cam means having a first camming surface adjustable dependent upon the folding box size; and a first cam follower engaging said first camming surface and connected to said other of said rollers.

4. The apparatus of claim 3 wherein said first camming surface comprises two mutually adjustable cam discs.

5. The apparatus according to claim 3 further including:

means for relieving tension on said ribbon when said ribbon is fed to the cutting station while adhered to said second folding box, said ribbon feeding being at a speed substantially equal to the feeding speed of the folding boxes.

6. The apparatus according to claim 5 wherein said tension relieving means includes:

a rocker arm in the feed path of said ribbon and mounted for pivotal movement about a pivot point intermediate its ends, said rocker arm including guide means for guiding said ribbon;

a second cam follower connected to said rocker arm, the pivoting of said rocker arm being controlled by the movement of said second cam follower; and said cam means having a second camming surface engaging with said second cam follower so as to cause said rocker arm to pivot during withdrawal of the ribbon.

7. The apparatus according to claim 6 wherein the pivoting of said rocker arm takes up the predetermined withdrawal length of the ribbon as well as a further length of ribbon supplied by said feeding means, said second camming surface being arranged so that the ribbon lengths taken up by said rocker arm are sufficient to substantially neutralize ribbon tension when said ribbon is fed to the cutting station.

8. The apparatus according to claim 7 wherein said second camming surface has a first surface portion, a second surface portion and a third surface portion, and said feeding means includes a switch means in the pivot path of said rocker arm and adapted to be actuated thereby, said second camming surface cooperating with said second cam follower along said first surface portion concurrent with withdrawal of the ribbon and at the end of said first surface portion, said rocker arm actuates said switch means to stop further feeding of the ribbon, said rocker arm is stationary during the time said second cam follower cooperates with said second surface portion and said ribbon is adhered to said open end of said second folding box, said rocker arm releasing said switch means when said second cam follower cooperates with said third surface portion.

* * * * *